United States Patent [19]

Gaisch et al.

[11] Patent Number: 4,572,219

[45] Date of Patent: Feb. 25, 1986

[54] PROCESS FOR IMPROVING TOBACCO

[75] Inventors: Helmut Gaisch, Cormondreche; Urs Nyffeler, Corcelles, both of Switzerland

[73] Assignee: Fabriques de Tabac Reunies S.A., Neuchatel, Switzerland

[21] Appl. No.: 4,626

[22] Filed: Jan. 19, 1979

[51] Int. Cl.[4] ..... A24B 3/14; A24B 15/02

[52] U.S. Cl. ..... 131/308; 131/356; 435/267; 210/603; 210/605; 210/903; 210/622

[58] Field of Search ..... 131/143, 140 C, 141, 131/140 R, 140 B, 308, 297, 356; 210/601, 603, 605, 622, 903; 435/172, 262, 267

[56] References Cited

U.S. PATENT DOCUMENTS

| | | | |
|---|---|---|---|
| 3,829,377 | 2/1974 | Hashimoato | 210/11 |
| 3,847,164 | 11/1974 | Mattina et al. | 141/143 |
| 4,131,118 | 12/1978 | Gellatly et al. | 131/143 |
| 4,308,877 | 1/1982 | Mattina | 131/308 |

OTHER PUBLICATIONS

"Det. Nit. Red. by Entero . . . "; Chem. Abst. 68:19735u; Daubner et al.; 1967.

"Treat. Wastewater Con. Fec. . . . "; Chem. Abst. 87:188939m; Kanekuni et al.; Nov. 11, 1975.

"Red. Nit. Bac. of . . . "; Chem. Abst. 57:7719; Daubner; 1962.

*Primary Examiner*—V. Millin

*Assistant Examiner*—Gregory Beaucage

*Attorney, Agent, or Firm*—Arthur I. Palmer, Jr.; James F. Haley, Jr.; Margaret A. Pierri

[57] ABSTRACT

A process for reducing the content of nitrate and/or nitrite salts contained in tobacco is disclosed whereby tobacco is treated, under controlled aerobic conditions, with microorganisms capable of degrading nitrates and/or nitrites to other nitrogen-containing compounds, such as proteins and amino acids.

10 Claims, No Drawings

PROCESS FOR IMPROVING TOBACCO

TECHNICAL FIELD

The invention concerns a process for treating tobacco whereby the nitrates and/or nitrites contained in tobacco are reduced.

Many tobaccos, Burley for example, contain salts of nitrates and/or nitrites. There are known fermentation processes in which these nitrogen salts are reduced by way of enzymes, however, only to a very small extent, and only as a side-effect of other enzymatic conversions.

BRIEF SUMMARY OF THE INVENTION

It is the purpose of this invention to reduce nitrates and/or nitrites to a lower level in tobacco in order to improve the smoking qualities thereof. The selective reduction of nitrates and/or nitrites is achieved without adversely affecting other constitutents present in tobacco.

The invention discloses the use of culture of microorganisms that require nitrogen and are capable of living aerobically by denitration. The culture of microorganisms is brought to its exponential growth phase under aerobic conditions in a nutrient solution that is substantially free of available nitrogen with the exception of nitrates and/or nitrites. The microorganisms degrade the nitrates and/or nitrites until they are reduced to the desired level. After no longer than 24 hours, the effect of the microorganisms is stopped. Under these conditions, the microorganisms will remain in their exponential growth phase as long as the necessary nitrogen requirements can be derived from the nitrates and/or nitrites.

DETAILED DESCRIPTION OF THE INVENTION

The microorganisms used herein utilize nitrogen from the nitrates and/or nitrites, whereby the latter are degraded to other nitrogen-containing compounds, such as amino acids and proteins. Both amino acids and proteins are naturally occurring compounds in tobacco and are considered desirable in that they are known to improve the flavor of tobacco smoke.

Since the added culture is already in its exponential growth phase, the microorganisms have a lead of about 8 hours over other microorganisms present, which are still in their lag phase. Such microorganisms thus cannot catch-up this lead within the reaction period, which is maximally 24 hours, and preferably about 16 hours, so that their effect is insignificant. This insures that the effect promoted by the invention will be selective.

Unfermented, air-dried tobaccos frequently have a nitrate content of about 50 g per kg dry weight. Nitrate quantities up to 80 g per kg dry weight have been found in extreme cases. The desired level of nitrates will depend on the ultimate use of the tobacco. For present purposes, however, the desired level of nitrates should be within the range of 3 to 20%, and preferably about 5% of the original content of the tobacco treated relative to the total weight of the anions of nitrate and/or nitrite.

It is possible to influence the selective effect of the microorganisms further by allowing a highly concentrated culture of microorganisms to react so that the nitrates and/or nitrites are reduced to a minimal level within 6 to 16 hours. Thereafter, the produced effect of the microorganisms is terminated immediately.

The minimal level, i.e., the level of nitrates and nitrites that can be achieved by the process of the invention without resorting to any extraordinary measures, depends on the quality of the tobacco, and amounts to from 0.01 to 0.1% of the original content of the treated tobacco, in each instance relative to the total weight of the anions of nitrate and/or nitrite. With such a concentrated application of microorganisms, the desired level can be realized after a few hours so that the effect of the microorganisms can be terminated before the microorganisms of the culture have used up their approximately 8-hour lead or shortly thereafter.

The effect of the microorganism culture can be intensified by controlling the substantially aerobic conditions for the microorganisms to an optimum with regard to temperature, humidity, pH level, nutrient supply, and by using a highly concentrated culture for reducing the nitrates and/or nitrites. The optimal conditions will be described hereinafter. The degree of reduction of nitrates and nitrites in tobacco may be ascertained analytically by known methods.

The effect of the microrganisms can be terminated by failure to maintain growing conditions for the microorganisms; for example, by greatly lowering or raising the temperature, by drying, and also by removing the microorganisms, as for example by filtration when the reaction is carried out in a liquid medium.

The microorganisms useful for this invention may be those selected from the genus Aerobacter, Pseudomonas, Micrococcus, or Echerichia; or, alternatively, they may be fungi selected from the genus Rhodutorula or Candida. Microorganisms isolated from the normal microflora of tobacco leaves are especially useful in that they have a particularly rapid denitrating effect and do not adversely alter the tobacco in an undesireable way.

One aspect of the invention provides a culture of microorganisms obtained by inoculating a watery smear of nitrate-containing leaves or decayed leaves into a nutrient solution. The solution contains a source of nitrogen required for growth, and is predominantly in the form of nitrates. The solution is buffered to a pH between about 6.6 and 7.5, and is then incubated aerobically at 25° to 35° C. for 6 to 16 hours with shaking and with intensive aeration under sterile conditions. The degree of aeration varies depending on the circumstances. Aeration in the range of about 150 to 400 ml/min is generally used during culture preparation while increased aeration up to about 3000 ml/min is generally used when treating tobacco materials. The thus prepared culture is then used as an active inoculum for the inoculation of another fresh nutrient solution, which is incubated in a similar manner. Transfers are repeated until a pure culture is obtained.

Preferably the smear is made from tobacco leaves. But a useable smear can also be obtained from forest soil comprising decayed leaves or containing decayed leaves therein. According to this method, a pure culture may be obtained wherein the microorganisms are in their active, i.e., their exponential growth phase. This culture is either used immediately or it is inactivated and preserved for later use.

The invention may advantageously be practiced utilizing a pure culture of *Enterobacter aerogenes,* preferably of type strain ATCC 13048. Pure cultures of this type strain may be obtained from the American Type Culture Collection, 12301 Park Lawn Drive, Rockville, Md. 20852.

When, for example, the tobacco to be treated includes strip, leaf, or stems, denitration is greatly facilitated if the tobacco is first extracted with water to remove the soluble nitrates and/or nitrites. Thereafer, the aqueous extract is inoculated with the microorganism culture, the nutrient solution is added, and the mixture is incubated for 6 to 16 hours under sterile aerobic conditions with substantial aeration of about 1000 to about 1500 ml/min of air. After an appropriate time period, the effect of the microorganisms is stopped by removing the active microorganisms by filtration, centrifugation, or the like. The treated extract solution from which the nitrates and/or nitrites have been reduced is concentrated and reapplied to the original tobacco material. In some instances, the entire denitrated extract containing the microorganisms may be concentrated and reapplied to tobacco materials, for example by spraying, and thereafter the tobacco is dried for a period of time sufficient to deactivate all microbial activity. The final moisture content of the tobacco should be in the range of about 10 to about 30%.

In some instances, as for example in making reconstituted tobacco, the tobacco materials are homogenized and made into a slurry. The slurry is cast into a sheet, which is then dried. In this instance, the microorganisms may be applied advantageously to the tobacco slurry. Preferably the tobacco is ground and mixed with water. The microorganism culture and the nutrient solution are added to the slurry, and the mixture is incubated for 6 to 16 hours under aerobic conditions. The effect of the microorganisms is stopped by casting the slurry into or onto sheets and drying them to a moisture content between about 10 and 30%.

The microorganism culture used is preferably a pure culture whereby the degree of purity must be sufficient to prevent substantial side effects. The microorganism culture can be preserved by freezing in liquid nitrogen and is thawed and reactivated before use. For immediate use, it can be kept in an active state in a biostat from which the continually required portions can be removed.

Characteristics of *Enterobacter aerogenes* 13048 are as follows:

| | |
|---|---|
| Motile rods | 0.3–1.5 μm |
| Gram | − |
| Development of gas at 37° C. | |
| Glycerin | + |
| Inositol | + |
| Andonitol | + |
| Voges-Proskauer | + |
| Methlred | − |
| Phenylamindesaminase | − |
| Urease | − |
| Catalase | + |
| Ornithindecarboxylase | + |
| Lysindecarboxylase | + |
| Hydrolyse of Aesculin | + |
| Growth: | |
| In presence of KCN | + |
| Upon Malonate as the only source of carbon | + |

The invention is emplified by the descriptions hereinbelow.

EXAMPLE 1

Preparation of the Pure Culture

Twenty g of D-glucose, 6.4 g of NaCl, 3.5 g of $KNO_3$; 4.5 g of $KH_2PO_4$, and 23.5 g of $Na_2HPO_4.2H_2O$ were dissolved in 1 liter of water. The thus obtained nutrient broth was divided into 5 equal aliquots of 200 ml each. Each aliquot was placed in a 500 ml Erlenmeyer flask, and the flasks were closed with a porous stopper in order to allow gasses formed during the process to escape and to facilitate sterilization. The broths were sterilized and stored at 20° C.

One-hundred grams of dry Burley tobacco leaves were washed with 500 ml water under sterile conditions. One ml of the resulting wash suspension was drawn off under sterile conditions and added to aliquot I of the nutrient broth. Aliquot I was incubated on a shaker for 16 hours at 30° C. with aeration of 200 ml/min of air. Then 1 ml of the incubated aliquot was removed under sterile conditions and inoculated into aliquot II of the nutrient solution, and the incubation was repeated. This serial transfer procedure was repeated until the fifth aliquot was treated.

After aliquot V had been incubated for 16 hours, it contained a pure culture of microorganisms of a genus Enterobacter that derives its nitrogen requirements via the reduction of nitrates and/or nitrites. The microorganisms of this pure culture are in their exponential growth phase and remain so for approximately 8 hours.

EXAMPLE 2

One kg of Maryland tobacco was processed to separate the stems from the strip. This yielded 250 g of stems and 750 g of strips. The 250 g of stems were washed with 1250 ml warm water at 70° C. This removed nitrates and nitrites contained in the stems together with other water-soluble components. The aqueous stem extract solution was separated from the stems, placed in a 2 liter Erlenmeyer flask, closed with a porous stopper, and cooled to 30° C. Then 12.5 g of D-glucose and 10 ml of the culture prepared in Example 1 were added to the flask. The microorganisms of the pure culture were still in their exponential growth phase.

The inoculated stem extract solution was incubated on a shaker at 30° C. for 16 hours and aerated under sterile conditions at 1300 ml/min of air. The thus obtained denitrated stem extract solution was immediately centrifuged, and the residual microorganisms were removed.

The centrifuged, denitrated stem extract was concentrated and reapplied to the predried, washed stems, which were then dried to a moisture level of 20%. In this manner, all of the soluble tobacco components that had been removed previously with the nitrates and/or nitrites were returned to the stems so that the stems contained essentially all of their original components with the exception of the nitrates and/or nitrites.

EXAMPLE 3

A tobacco stem extract was treated in a similar manner to Example 2. After separating the denitrated stem extract solution by centrifuging, the extract was applied to a different type of washed tobacco stems.

EXAMPLE 4

Using the same procedure as shown in Example 2, tobacco stems were incubated for approximately 20 hours. At this point it was noted that approximately 50% of the nicotine present in the extract had been reduce and there were only trace amounts of nitrates and nitrites present.

EXAMPLE 5

One kg of Maryland tobacco was destemmed and yielded 250 g of stems and 750 g of strips. The 250 g of stems were treated according to the process of Example 2.

The 750 grams of tobacco strip were dipped in 1250 ml water at 50° C. whereby the nitrates and nitrites were extracted from the surface regions of the strip. The resulting extract was treated in a similar manner to Example 2. The nitrates and nitrites were reduced to approximately 0.1 g per liter of extract. The denitrated extract was then centrifuged, concentrated, and reapplied by spraying to the previously extracted tobacco strip.

EXAMPLE 6

Two hundred fifty g of Burley tobacco leaves were washed in 1250 ml warm water at 50° C. The resulting tobacco extract solution was treated in a similar manner to Example 2. Thereafter, the denitrated tobacco extract solution was centrifuged to separate and recover the active microorganisms, and the denitrated extract was reapplied to the tobacco leaves.

EXAMPLE 7

One kg of tobacco scraps was ground to a granular size no greater than 150 μm. One hundred fifty ml of a suspension of active microorganisms obtained according to Example 1 and still in their exponential growth phase was added to a broth containing 30 g D-glucose, 9.6 g NaCl, 6.75 g $KH_2PO_4$, and 35.25 g $Na_2PO_4.2H_2O$ in 1500 ml water. The mixture of active microorganisms and nutrients was stirred into the powdered tobacco, and the resulting slurry was incubated for 24 hours at 30° C. in a 10-liter Erlenmeyer flask equipped with a porous stopper. The mixture was aerated under sterile conditions at 3000 ml/min of air. The microorganisms reduced the nitrates and/or nitrites contained in the tobacco slurry to 1/10 of the original content. Immediately afterwards, 150 g carboxymethylcellulose was stirred into the slurry, and the slurry was cast in a layer of 3 mm thickness and dried to a 15% moisture content. This terminated the effect of the microorganisms and solidified the slurry into sheets of reconstituted tobacco, which were then ready for further processing.

EXAMPLE 8

The procedure of Example 7 was repeated in a similar manner except that the period of incubation was extended in analogy to example 4 until approximately 50% of the nicotine had also been degraded.

EXAMPLE 9

Tobacco stems were extracted according to the method of Example 2, and the extract was inoculated with a pure culture of *Enterobacter aerogenes ATCC* 13048 prepared generally according to the procedure detailed in Example 1. Incubation conditions and reapplication of the denitrated extract were identical to Example 2.

EXAMPLE 10

The process of Example 9 was repeated under identical conditions with the exception that the denitrated stem extract was reapplied to a different type of washed tobacco stems.

EXAMPLE 11

Two hundred fifty g of burley tobacco leaves were washed in 1250 ml warm water at 50° C. The resulting tobacco extract solution was inoculated with *Enterobacter aerogenes* 13048 as in Example 2. Following denitration, the tobacco extract solution was centrifuged to separate the microorganisms. Thereafter, the extract was reapplied to the tobacco leaves.

EXAMPLE 12

Tobacco stems were extracted as in Example 2 and inoculated with a pure culture of *Enterobacter aerogenes* 13048. The stem extract solution was incubated on a shaker at 30° C. for 8 hours so that the anions of nitrate and nitrite were reduced to a lesser extent than they were according to Example 2.

The denitrated stem extract solution was centrifuged, concentrated, and reapplied to the stems, that had been predried and washed. The stems were dried to a moisture content of 20%.

EXAMPLE 13

Maryland tobacco leaves were extracted in a similar manner to Example 6, inoculated with a culture of *Enterobacter aerogenes* 13048, and incubated for 8 hours at 30° C. During this period the microorganisms reduced the nitrates and/or nitrites contained in the strips. The strips were then further treated as described in Example 11.

What is claimed is:

1. A microbial process for reducing the content of nitrates or nitrites contained in tobacco material under controlled aerobic conditions comprising the steps of a. extracting tobacco material with water to obtain an aqueous tobacco extract and a tobacco residue, b. inoculating the tobacco extract obtained in Step (a) with a concentrated culture of microorganisms selected from the genus Enterobacter, said microorgansisms being in their exponential growth phase, c. incubating the inoculated tobacco extract with aeration at a rate up to about 3000 ml/min at a pH of about 6.6 to about 7.5 and a temperature between about 25° to 35° C. for a period of time sufficient to reduce the nitrates or nitrates contained therein to a lower level, d. terminating the activity of the microorganisms and e. thereafter concentrating and reapplying the extract to the tobacco residue and drying the resulting product to a moisture content of about 10 to 30%.

2. A process according to claim 1 wherein the tobacco material is selected from the group consisting of tobacco leaf, strip, and stem.

3. A process according to claim 1 wherein the microorganism is *Enterobacter aerogenes* 13048.

4. A process according to claim 1 wherein the incubation is conducted for a period of time not exceeding 24 hours.

5. A process according to claim 4 wherein the incubation is conducted for about 6 to about 16 hours.

6. A process according to claim 1 wherein the inoculated extract is aerated under sterile conditions at a rate of about 1000 to about 1500 ml/min with air.

7. A process according to claim 1 wherein the microorganisms are separated from the denitrated extract by centrifugation or filtration after Step (c).

8. A process according to claim 1 wherein the extract which is concentrated and reapplied to the tobacco residue contains the microorganisms.

9. A microbial process for reducing the nitrate and nitrites contained in a homogenized slurry of tobacco materials comprising the steps of a. inoculating the homogenized slurry with a concentrated culture of microorganisms selected from the genus Enterobacter, said microorganisms being in their exponential growth phase, b. incubating the inoculated slurry under sterile conditions at a pH of about 6.6 to 7.5 and a temperature between about 25° to 35° C. with aeration of about 150 to 3000 ml/min for a period of time sufficient to effect a reduction in the nitrate or nitrite content of the slurry, and c. casting the resulting denitrated slurry into or onto sheets and thereafter drying the sheets to a moisture content of about 10 to about 30% to produce reconstituted tobacco.

10. The process according to claim 9 wherein the microorganism is *Enterobacter aerogenes* 13048.

* * * * *